US009132642B2

(12) United States Patent
Onodera et al.

(10) Patent No.: US 9,132,642 B2
(45) Date of Patent: Sep. 15, 2015

(54) HEAD CLEANING METHOD AND LIQUID DISCHARGING APPARATUS

(71) Applicant: SEIKO EPSON CORPORATION, Tokyo (JP)

(72) Inventors: Katsuyoshi Onodera, Chino (JP); Norihiro Masuda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/211,218

(22) Filed: Mar. 14, 2014

(65) Prior Publication Data

US 2014/0292915 A1 Oct. 2, 2014

(30) Foreign Application Priority Data

Mar. 27, 2013 (JP) ..... 2013-065770

(51) Int. Cl.
*B41J 2/165* (2006.01)
*B41J 2/18* (2006.01)

(52) U.S. Cl.
CPC ..... *B41J 2/16538* (2013.01); *B41J 2/16585* (2013.01); *B41J 2/18* (2013.01); *B41J 2002/16573* (2013.01)

(58) Field of Classification Search
CPC ..... B41J 2/16535
USPC ..... 347/30, 32, 33, 34, 84, 85
See application file for complete search history.

(56) References Cited

U.S. PATENT DOCUMENTS

2006/0170727 A1 8/2006 Imazeki et al.
2010/0321425 A1 * 12/2010 Kanke et al. ..... 347/6

FOREIGN PATENT DOCUMENTS

JP 2006-212863 8/2006

* cited by examiner

*Primary Examiner* — Manish S Shah
*Assistant Examiner* — Roger W Pisha, II
(74) *Attorney, Agent, or Firm* — Workman Nydegger

(57) ABSTRACT

In a liquid discharging apparatus that includes a circulation flow path, a head cleaning method includes a first process in which a flow rate of the liquid flowing through the circulation flow path per unit time is set at a first flow rate; a second process in which, after the first process is completed, a wiping unit carries out a wiping operation in a state where the liquid is discharged from the nozzle; a third process in which, after the second process is completed, the wiping unit carries out the wiping operation in a state where the liquid is not discharged from the nozzle; and a fourth process in which, after the third process is completed, a flow rate of the liquid flowing through the circulation flow path per unit time is set at a second flow rate that is lower than the first flow rate.

7 Claims, 9 Drawing Sheets

<LOW SPEED CIRCULATION MODE>

<HIGH SPEED CIRCULATION MODE>

HEAD CLEANING METHOD AND LIQUID DISCHARGING APPARATUS

BACKGROUND

1. Technical Field

The present invention relates to a head cleaning method and a liquid discharging apparatus.

2. Related Art

An example of a liquid discharging apparatus is an ink jet printer (hereinafter, printer) in which ink (liquid) is discharged from a nozzle provided in a head. In the printer, since foreign matter such as ink, paper dust or the like adheres to a nozzle opening surface of the head, a wiping operation is regularly carried out in which the foreign matter is wiped off from the nozzle opening surface by a wiper. When ink adheres to the nozzle opening surface for a long time, the ink thickens and solidifies and thus, is not completely wiped off by only the wiper. Accordingly, a method is proposed in which the wiping operation is carried out when the nozzle discharges ink. In this way, the thickened and solidified ink can be dissolved and wiped off by the wiper wet with the ink. Thereafter, when the wiping operation is carried out again without the ink being discharged from the nozzle (a dry wiping operation is carried out), it is possible to more thoroughly clean the nozzle opening surface (refer to JP-A-2006-212863).

However, when the wiping operation is carried out, there is a case where ink in the nozzle is guided by the ink adhering to the wiper and is drawn out by the wiper. For this reason, in a case where the wiping operation is carried out without the ink being discharged from the nozzle, when a pressure applied to the ink in the head is low, the nozzle from which the ink is drawn out by the wiper cannot be replenished with the ink. As a result, air bubbles remain in the nozzle, and a discharge failure occurs. In contrast, when a pressure applied to the ink in the head increases in such a manner that the nozzle is replenished with the ink after the ink is drawn out from the nozzle by the wiper, the ink cannot be discharged from the nozzle during printing, and a discharge failure occurs.

SUMMARY

An advantage of some aspects of the invention is that a nozzle opening surface of a head is cleaned and a nozzle is prevented from failing to discharge ink.

A liquid discharging apparatus according to an aspect of the invention includes a circulation flow path having a head at which a nozzle is provided to discharge liquid onto a recording medium, a storage unit that stores the liquid, a first flow path through which the liquid is supplied from the storage unit to the head, and a second flow path through which the liquid flows back to the storage unit from the head; a pump that circulates the liquid through the circulation flow path; and a wiping unit that moves relative to the head in a state where the wiping unit is in contact with a nozzle opening surface of the head and thus, carries out a wiping operation in which foreign matter adhering to the nozzle opening surface is wiped off, the invention provides a head cleaning method including a first process in which a flow rate of the liquid flowing through the circulation flow path per unit time is set at a first flow rate; a second process in which, after the first process is completed, the wiping unit carries out the wiping operation in a state where the liquid is discharged from the nozzle; a third process in which, after the second process is completed, the wiping unit carries out the wiping operation in a state where the liquid is not discharged from the nozzle; and a fourth process in which, after the third process is completed, a flow rate of the liquid flowing through the circulation flow path per unit time is set at a second flow rate that is lower than the first flow rate.

Other characteristics of the invention will be made clear from the present specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Overview of Disclosure

Figure 1A:
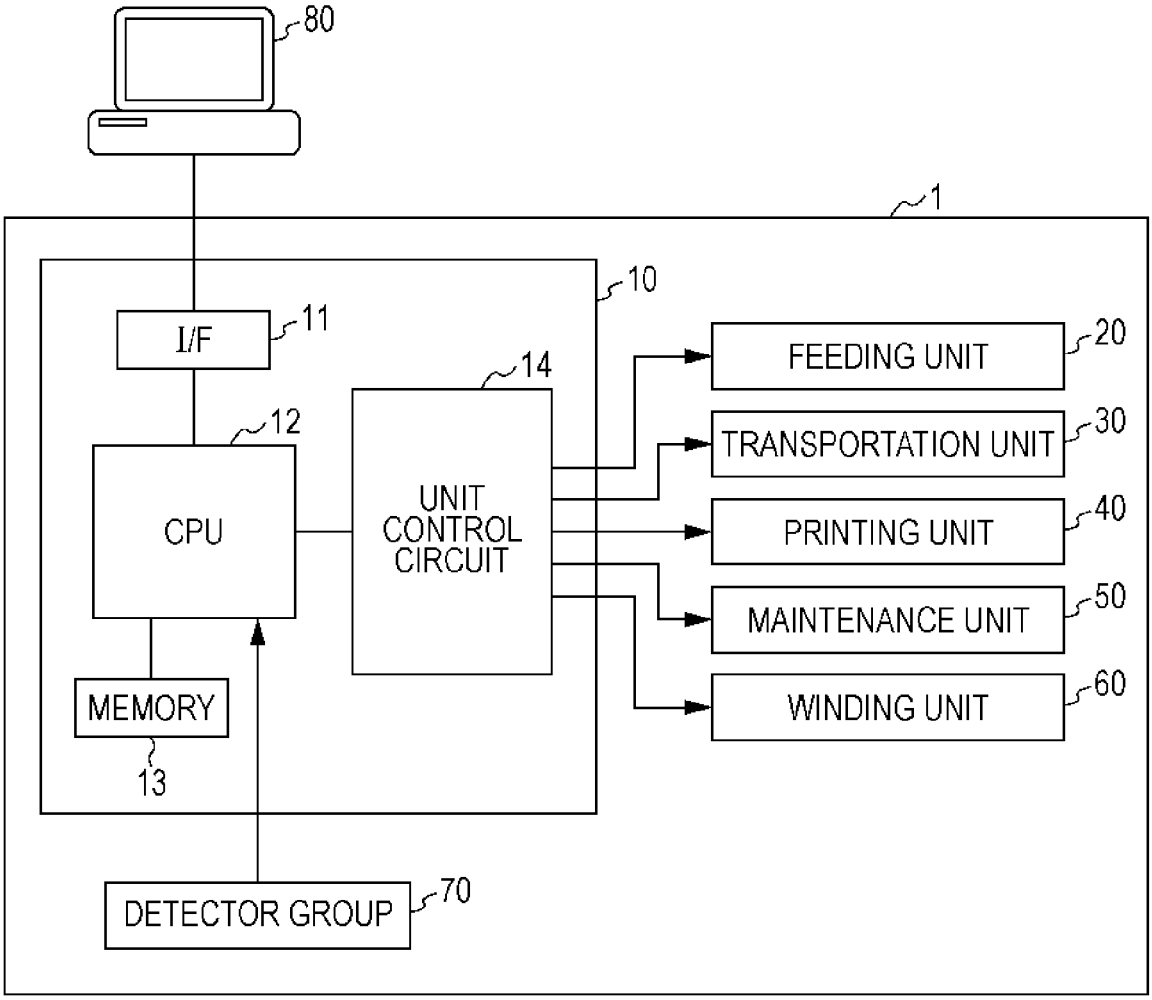
FIG. 1A is a block diagram illustrating an entire configuration of a printing system.

At least the following will be made clear from a description of the present specification and the accompanying drawings.

A liquid discharging apparatus includes a circulation flow path having a head at which a nozzle is provided to discharge liquid onto a recording medium, a storage unit that stores the liquid, a first flow path through which the liquid is supplied from the storage unit to the head, and a second flow path through which the liquid flows back to the storage unit from the head; a pump that circulates the liquid through the circulation flow path; and a wiping unit that moves relative to the head in a state where the wiping unit is in contact with a nozzle opening surface of the head and thus, carries out a wiping operation in which foreign matter adhering to the nozzle opening surface is wiped off. There is a head cleaning method including a first process of setting a flow rate of the liquid flowing through the circulation flow path per unit time at a first flow rate; a second process of carrying out the wiping operation by the wiping unit in a state where the liquid is discharged from the nozzle after the first process is completed; a third process of carrying out the wiping operation by the wiping unit in a state where the liquid is not discharged from the nozzle after the second process is completed; and a fourth process of setting a flow rate of the liquid flowing through the circulation flow path per unit time at a second flow rate that is lower than the first flow rate after the third process is completed.

According to the head cleaning method, it is possible to carry out the wiping operation while dissolving thickened and solidified liquid that adheres to the nozzle opening surface of the head. In addition, it is possible to finish the cleaning operation in a state where the nozzle is replenished with the liquid and a meniscus of the liquid formed at the nozzle is set to have an appropriate shape when the liquid is discharged onto the recording medium.

In the head cleaning method, in the third process, a meniscus of the liquid formed at the nozzle may protrude to an outside of the head farther outward than the nozzle opening surface. In the fourth process, the meniscus may be drawn to an inside of the head farther inward than the nozzle opening surface.

According to the head cleaning method, it is possible to finish the cleaning operation in a state where the nozzle is replenished with the liquid and a meniscus of the liquid formed at the nozzle is set to have an appropriate shape when the liquid is discharged onto the recording medium.

In the head cleaning method, when the liquid is discharged onto the recording medium, a flow rate of the liquid flowing through the circulation flow path per unit time may be set equal to the second flow rate.

According to the head cleaning method, it is possible to start an operation of discharging the liquid onto the recording medium immediately after the fourth process is completed.

In the head cleaning method, the liquid discharging apparatus may include a pressure regulation unit that regulates a pressure in the storage unit. In the first process, a rate of the liquid fed by the pump may be regulated and thus, a flow rate of the liquid flowing through the circulation flow path per unit time may be set at the first flow rate. In the second process, the pressure regulation unit may increase a pressure in the storage unit in a state where a rate of the liquid fed by the pump remains unchanged from that of the first process. In the third process, the pressure regulation unit may stop increasing a pressure in the storage unit in a state where a rate of the liquid fed by the pump remains unchanged from that of the first process. In the fourth process, a rate of the liquid fed by the pump may decrease compared to in the first process.

According to the head cleaning method, in the second process, it is possible to carry out the wiping operation in a state where the liquid is discharged from the nozzle. In the third process, it is possible to carry out the wiping operation in a state where the liquid is not discharged from the nozzle. In the fourth process, it is possible to set a flow rate of the liquid flowing through the circulation flow path per unit time at the second flow rate.

In head cleaning method, the liquid discharging apparatus may include a pressure regulation unit that regulates a pressure in the storage unit. A rate of the liquid fed by the pump may be constant from the first process to the fourth process. In the first process, the pressure regulation unit may set a pressure in the storage unit at a first pressure and thus, a flow rate of the liquid flowing through the circulation flow path per unit time may be set at the first flow rate. In the second process, the pressure regulation unit may set a pressure in the storage unit at a second pressure that is greater than the first pressure. In the third process, the pressure regulation unit may set a pressure in the storage unit at a third pressure that is lower than the second pressure. In the fourth process, the pressure regulation unit may set a pressure in the storage unit at a fourth pressure that is lower than the first and the third pressures.

According to the head cleaning method, in the second process, it is possible to carry out the wiping operation in a state where the liquid is discharged from the nozzle. In the third process, it is possible to carry out the wiping operation in a state where the liquid is not discharged from the nozzle. In the fourth process, it is possible to set a flow rate of the liquid flowing through the circulation flow path per unit time at the second flow rate.

In the head cleaning method, in the first process, a rate of the liquid fed by the pump may be set at a first feed rate and thus, a flow rate of the liquid flowing through the circulation flow path per unit time may be set at the first flow rate. In the second process, a rate of the liquid fed by the pump may be set at a second feed rate that is greater than the first feed rate. In the third process, a rate of the liquid fed by the pump may be set at a third feed rate that is lower than the second feed rate. In the fourth process, a rate of the liquid fed by the pump may be set at a fourth feed rate that is lower than the first and the third feed rates.

According to the head cleaning method, in the second process, it is possible to carry out the wiping operation in a state where the liquid is discharged from the nozzle. In the third process, it is possible to carry out the wiping operation in a state where the liquid is not discharged from the nozzle. In the fourth process, it is possible to set a flow rate of the liquid flowing through the circulation flow path per unit time at the second flow rate.

A liquid discharging apparatus includes a circulation flow path that has a head at which a nozzle is provided to discharge liquid onto a recording medium, a storage unit that stores the liquid, a first flow path through which the liquid is supplied from the storage unit to the head, and a second flow path through which the liquid flows back to the storage unit from the head; a pump that circulates the liquid through the circulation flow path; a wiping unit that moves relative to the head in a state where the wiping unit is in contact with a nozzle opening surface of the head and thus, carries out a wiping operation in which foreign matter adhering to the nozzle opening surface is wiped off; and a control unit that sets a flow rate of the liquid flowing through the circulation flow path per unit time at a first flow rate and then, commands the wiping unit to carry out the wiping operation in a state where the liquid is discharged from the nozzle and then, commands the wiping unit to carry out the wiping operation in a state where the liquid is not discharged from the nozzle and then, sets a flow rate of the liquid flowing through the circulation flow path per unit time at a second flow rate that is lower than the first flow rate.

In the liquid discharging apparatus, it is possible to carry out the wiping operation while dissolving a thickened and solidified liquid that adheres to the nozzle opening surface of the head. In addition, it is possible to finish the cleaning operation in a state where the nozzle is replenished with the liquid and a meniscus of the liquid formed at the nozzle is set to have an appropriate shape when the liquid is discharged onto the recording medium.

Printing System

Hereinafter, embodiments will be described based on a case where an ink jet printer (hereinafter, a printer) is cited as the liquid discharging apparatus and a computer is connected to a printing system.

Figure 1B:
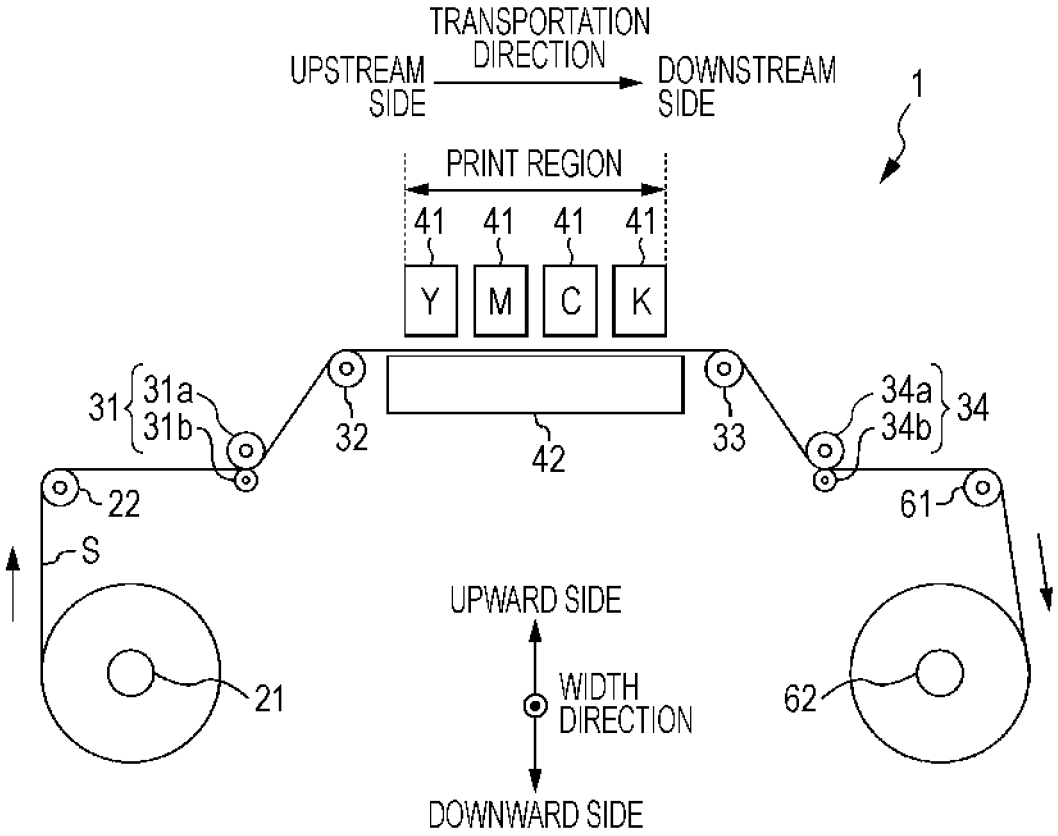
FIG. 1B is a schematic cross-sectional view of a printer.
Figure 2:
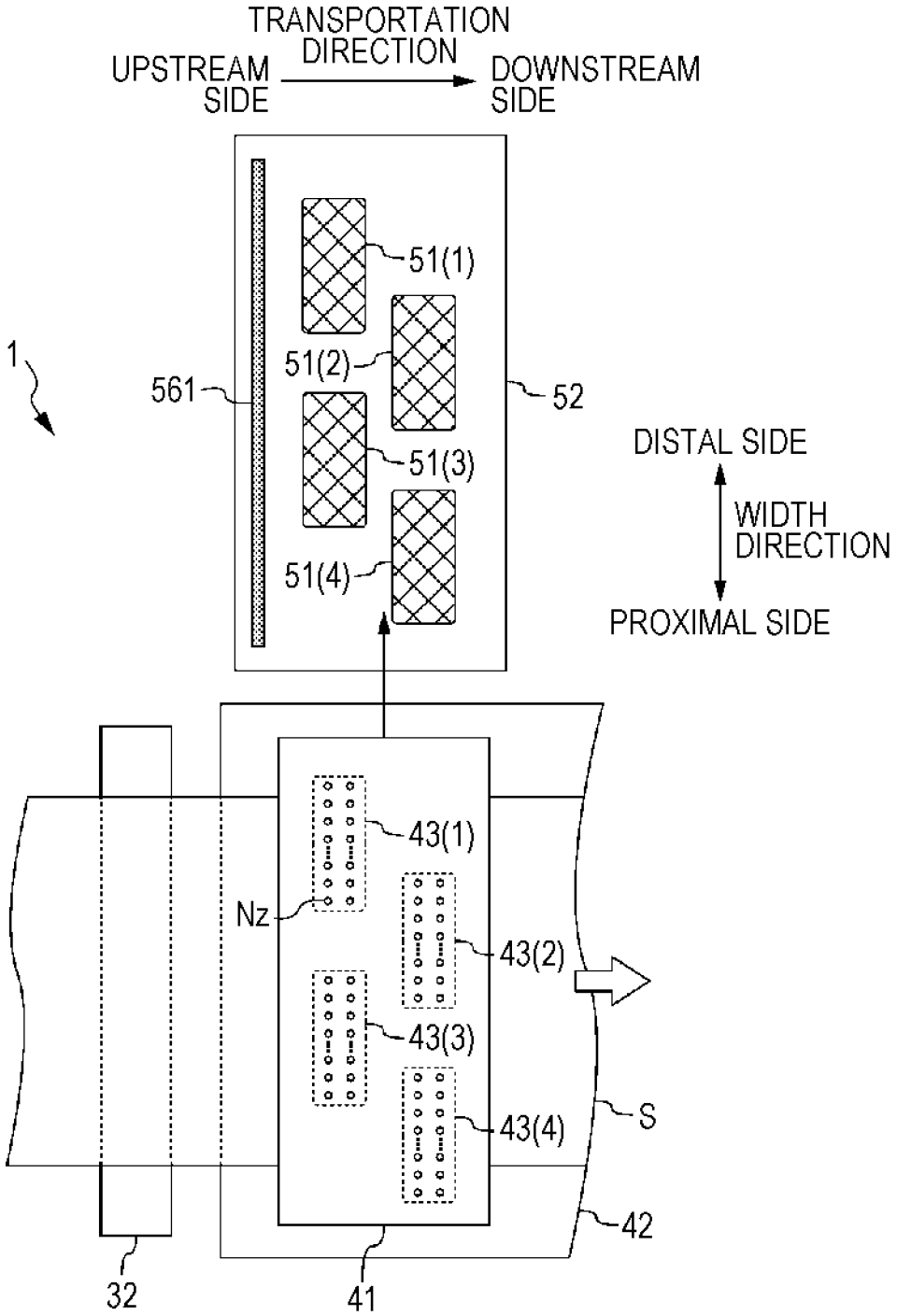
FIG. 2 is a schematic top view of the printer.
Figure 3:
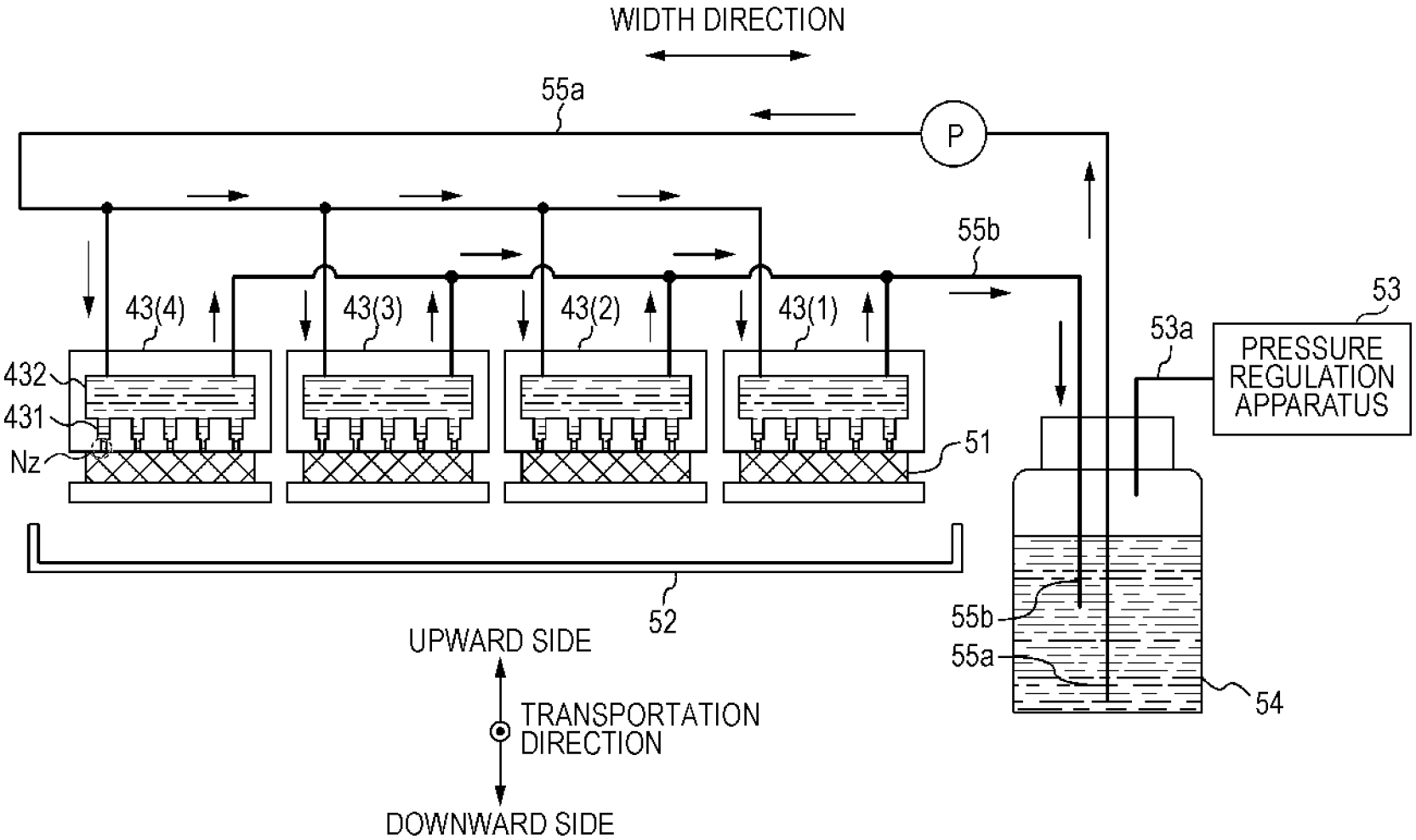
FIG. 3 is a view describing an ink circulation system in the printer.

FIG. 1A is a block diagram illustrating an entire configuration of the printing system, and FIG. 1B is a schematic cross-sectional view of a printer 1. FIG. 2 is a schematic top view of the printer 1. FIG. 3 is a view describing an ink circulation system in the printer 1. The printer 1 is connected to a computer 80 such that the printer 1 can communicate therewith. A printer driver installed in the computer 80 prepares printing data of which an image is printed by the printer 1, and outputs the printing data to the printer 1. The printer 1 has a controller 10, a feeding unit 20, a transportation unit 30, a printing unit 40, a maintenance unit 50, a winding unit 60 and a detector group 70.

The controller 10 in the printer 1 carries out an overall control of the printer 1. An interface unit 11 transmits and receives data from the computer 80 that is provided as an external apparatus or an internal apparatus. A CPU 12 is an arithmetic processing unit that carries out an overall control of the printer 1, and controls each unit via a unit control circuit 14. A memory 13 ensures a region for storing a program of the CPU 12, a working region and the like. The detector group 70 monitors an inner situation of the printer 1, and the controller 10 carries out a control based on a result detected by the detector group 70.

The feeding unit 20 has a winding shaft 21 that rotatably supports paper (hereinafter, continuous-form paper) wound in a continuous roll form and sends out continuous-form paper S by a rotation thereof, and a relay roller 22 that winds up the continuous-form paper S sent out from the winding shaft 21 and guides the continuous-form paper S to a pair of upstream transportation rollers 31. The recording medium on which the printer 1 prints an image is not limited to the continuous-form paper S and may have a form of cut paper, a cloth, a film or the like.

The transportation unit 30 has a plurality of relay rollers 32 and 33 that wind up and feed the continuous-form paper S; a pair of the upstream transportation rollers 31 that are disposed upstream of a printing region in a transportation direction; and a pair of downstream transportation rollers 34 that are disposed downstream of the printing region in the transportation direction. The upstream transportation rollers 31 and the downstream transportation rollers 34 have, respectively, driving rollers 31*a* and 34*a* which are connected to a motor (not illustrated) and are rotatively driven by the motor, and have, respectively, driven rollers 31*b* and 34*b* which are rotated by a rotation of the driving rollers. In a state where the continuous-form paper S is interposed by each of the upstream transportation rollers 31 and the downstream transportation rollers 34, when the driving rollers 31*a* and 34*a* are rotatively driven, a transportation force is given to the continuous-form paper S.

The printing unit 40 has a head unit 41 provided for each ink color, and a platen 42 that supports the continuous-form paper S in the printing region from a surface opposite a printing surface thereof. The printer 1 according to the embodiment can discharge four colors of ink that are a yellow (Y) ink, a magenta (M) ink, a cyan (C) ink and a black (K) ink, and as illustrated in FIG. 1B, four head units 41 are arranged in a row in the transportation direction. As illustrated in FIG. 2, each of the head units 41 has a plurality of short heads 43(1) to 43(4) arranged in rows in a width direction orthogonal to the transportation direction of the continuous-form paper S. In a surface (lower surface) in which each of the heads 43 faces the continuous-form paper S, a plurality of nozzles Nz (for example, nozzles of which each has the diameter of approximately 20 μm to 22 μm) which discharge ink are arranged in rows with predetermined gaps in the width direction. FIG. 2 virtually illustrates positions of the short heads 43 and the nozzles Nz when the head unit 41 is seen from above. The nozzles Nz are arranged in rows in the width direction at an end portion of the head, and a part of the nozzles Nz is positioned to overlap. In the lower surface of the head unit 41, the nozzles Nz are arranged in rows with predetermined gaps in the width direction and across the width of the continuous-form paper S or greater. Accordingly, when the nozzles Nz discharge ink onto the continuous-form paper S that is transported below the head units 41 without stopping, a 2-dimensional image is printed on the continuous-form paper S.

As illustrated in FIG. 3, each of the heads 43 has the nozzles Nz; a plurality of piezoelectric elements (not illustrated) that are provided, respectively, at the nozzles Nz; a plurality of ink chambers 431 that are provided, respectively, at the nozzles Nz to communicate therewith; and a common chamber 432 that communicates with the ink chambers 431. When a voltage is applied to the piezoelectric elements and the ink chambers 431 are expanded and contracted, ink is discharged from the nozzles Nz. A type of discharging the ink is not limited to the embodiment, and a thermal type may be adopted in which heating elements generate air bubbles in the nozzles and ink is discharged from the nozzles due to the air bubbles.

In the embodiment, the number of heads 43 belonging to the head unit 41 is four, but is not limited to four. The embodiment may be a printer in which the platen is a rotary drum that rotates about the width direction which is taken as a rotary shaft, the continuous-form paper S is wound up and transported by the rotary drum, and ink is discharged from the heads. In this case, the heads are arranged in a sloping manner along an arc-shaped outer circumferential surface of the rotary drum. For example, in a case where ink discharged from the heads 43 is an UV ink that is cured when the ink is irradiated with ultraviolet light, an irradiator is provided between the head units 41 or downstream thereof in the transportation direction to irradiate ultraviolet light.

The maintenance unit 50 supplies ink to the head 43, and cleans the head 43. As illustrated in FIGS. 2 and 3, the maintenance unit 50 has caps 51 that are in close contact with the heads 43; an ink receiving unit 52; a pressure regulation apparatus 53; an ink tank 54 (equivalent to the storage unit) that stores ink; a forward-path tube 55*a* (equivalent to the first flow path) through which the ink is supplied to the heads 43 from the ink tank 54; a return-path tube 55*b* (equivalent to the second flow path) through which the ink flows back to the ink tank 54 from the heads 43; a wiping unit 56; and a circulation pump P. The caps 51, the ink receiving unit 52 and the like are provided in a non-printing region that is positioned farther on a distal side in the width direction than a region in which the continuous-form paper S is transported, and the head unit 41 is configured to be movable in the width direction. Since the configurations illustrated in FIGS. 2 and 3 are common regardless of ink colors, the common description is applied to each of the ink colors.

The cap 51 is a rectangular member made of an elastic member or the like, and is provided at each of the heads 43. In conformance to the arrangement of the heads 43(1) to 43(4) in the head unit 41, caps 51(1) to 51(4) are also arranged in the width direction. Accordingly, when the head unit 41 moves to the distal side in the width direction, the heads 43 and the caps 51 face each other. When the head unit 41 moves downward (or, when the caps 51 moves upward), the caps 51 is in close contact with nozzle opening surfaces of the heads 43 so that the nozzles Nz can be sealed. When the heads 43 are cleaned, the ink receiving unit 52 receives ink discharged from the nozzles Nz.

One end of the forward-path tube 55*a* is connected to the ink tank 54, and the other end is connected to the heads 43. One end of the return-path tube 55*b* is connected to the heads 43, and the other end is connected to the ink tank 54. A circulation flow path is formed by the heads 43, the ink tank 54, the forward-path tube 55*a* and the return-path tube 55*b*. The circulation pump P (equivalent to the pump) is provided in the middle of the forward-path tube 55*a* to circulate ink through the circulation flow path. By a drive of the circulation pump P, ink is sequentially circulated from the ink tank 54 to the forward-path tube 55*a* to the heads 43 to the return-path tube 55*b* to the ink tank 54, and ink in the ink tank 54 is supplied to the heads 43. Since ink is circulated, it is possible to make a concentration of the ink uniform by stirring ink containing a color material that is likely to precipitate, and it is possible to constantly maintain a temperature of the ink or to remove air bubbles from the ink by a heater or a deaerator (not illustrated) provided in the middle of the circulation flow path. The embodiment may have a configuration in which the ink tank 54 is set to be a sub-tank, and ink is supplied to the ink tank 54 from a tank (ink cartridge or the like) that is provided upstream of the ink tank 54. The circulation pump P may be provided in the return-path tube 55*b*.

In the embodiment, when a gear pump is used as the circulation pump P and the circulation pump P rotates in a normal direction, ink is fed to the heads 43 from the ink tank 54 via the forward-path tube 55*a*. The circulation pump P is not limited to the gear pump, and for example, the circulation pump P may be a tube pump or the like. The number of revolutions of the circulation pump P is variable, and when the number of revolutions of the circulation pump P is regulated, it is possible to change at multiple stages a rate (feed rate) at which the circulation pump P transfers ink per unit time.

The pressure regulation apparatus 53 (equivalent to the pressure regulation unit) regulates a pressure in the ink tank 54. When the pressure regulation apparatus 53 draws air out of the ink tank 54 via an air tube 53 of which an end portion is provided in an air layer of the ink tank 54, a pressure in the ink tank 54 decreases. When the pressure regulation apparatus 53 supplies air into the ink tank 54, a pressure in the ink tank 54 increases. The pressure regulation apparatus 53 can change a pressure in the ink tank 54 at multiple stages.

When an image is printed on the continuous-form paper S, the controller 10 controls the circulation pump P in such a manner that the circulation pump P rotates in the normal direction at a low speed (the number of revolutions per unit time is N0). For this reason, when an image is printed, a transfer rate of ink per unit time by the circulation pump P becomes relatively low (q0). When an image is printed, the controller 10 suspends a pressure increase by the pressure regulation apparatus 53 in such a manner that a pressure in the ink tank 54 is controlled not to increase. For this reason, when an image is printed, a pressure in the ink tank 54 has a relatively small value (P0). Accordingly, when an image is printed, the printer 1 is set to a "low speed circulation" mode in which a rate (Q0) of ink flowing through the circulation flow path (the forward-path tube 55*a*, the return-path tube 55*b* or the heads 43) per unit time is low.

The winding unit 60 has a relay roller 61 that winds up the continuous-form paper S fed from the downstream transportation rollers 34 and feeds the continuous-form paper S, and a winding driving shaft 62 that winds the continuous-form paper S fed from the relay roller 61. When the winding driving shaft 62 is rotatively driven, the printed continuous-form paper S is sequentially wound in a roll form.

Method of Cleaning Head

When ink is discharged from the nozzles Nz, main ink droplets and very small ink droplets are generated, and the very small droplets fly up into the air in a mist form to adhere to the nozzle opening surfaces of the head 43. Not only ink but also dust, paper powder dust and the like adhere to the nozzle opening surfaces of the head 43. When the foreign matter adhering to the nozzle opening surfaces of the head 43 are left as they are and the foreign matter is deposited, the nozzles Nz are blocked and the nozzles Nz are prevented from discharging ink. For example, the nozzles Nz do not discharge a prescribed amount of ink, or the ink discharged from the nozzles Nz does not fly in a target direction. As a result, image quality of a printed image deteriorates.

In the printer 1 according to the embodiment, the wiping unit 56 regularly carries out a "wiping operation" as a method of cleaning the head 43. As illustrated in FIGS. 6A to 6D to be described later, the wiping unit 56 has a wiper 561 that is a plate-shaped member made of an elastic member, cloth, felt or the like, and a movement mechanism 562 that moves the wiper 561 in the transportation direction with respect to the head 43. In a state where a tip end portion of the wiper 561 is in contact with a nozzle opening surface 43*a* of the head 43, when the controller 10 (equivalent to the control unit) in the printer 1 moves in the transportation direction the wiper 561 with respect to the head 43, a wiping operation is carried out in which foreign matter such as ink and the like adhering to the nozzle opening surface 43*a* of the head 43 are wiped off.

In the embodiment, as illustrated in FIG. 2, one wiper 561 is provided for one of the head units 41, and a length in the width direction of the wiper 561 is equal to or greater than a length obtained by summing up lengths of the four heads 43 that are arranged in rows in the width direction in the head unit 41. Accordingly, once the wiper 561 moves only one time in the transportation direction, the wiper 561 can wipe the entire nozzle opening surfaces of the four heads 43 belonging to the head unit 41. The embodiment is not limited to the configuration, the wiper 561 may be provided for each of the heads 43, and only the one wiper 561 may be provided for the four head units 41. The head unit 41 may move in the transportation direction with respect to the wiper 561, and both of the wiper 561 and the head unit 41 may move.

COMPARISON EXAMPLE

Figure 4A:
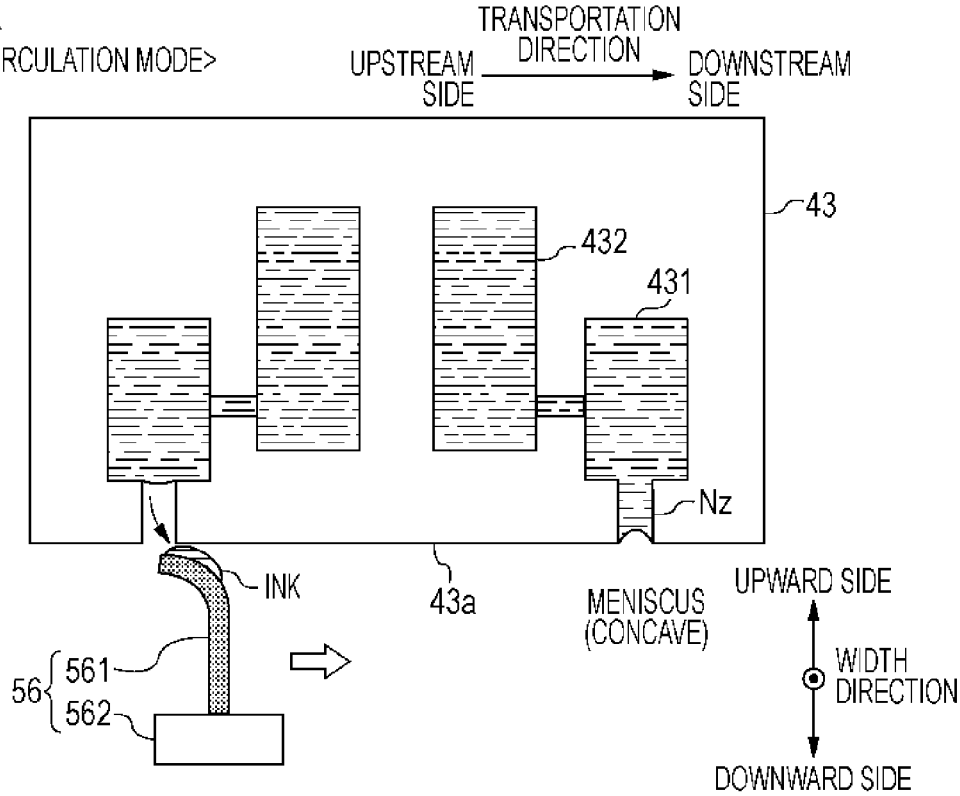
FIGS. 4A and 4B are views describing a wiping operation of Comparison Example.
Figure 4B:
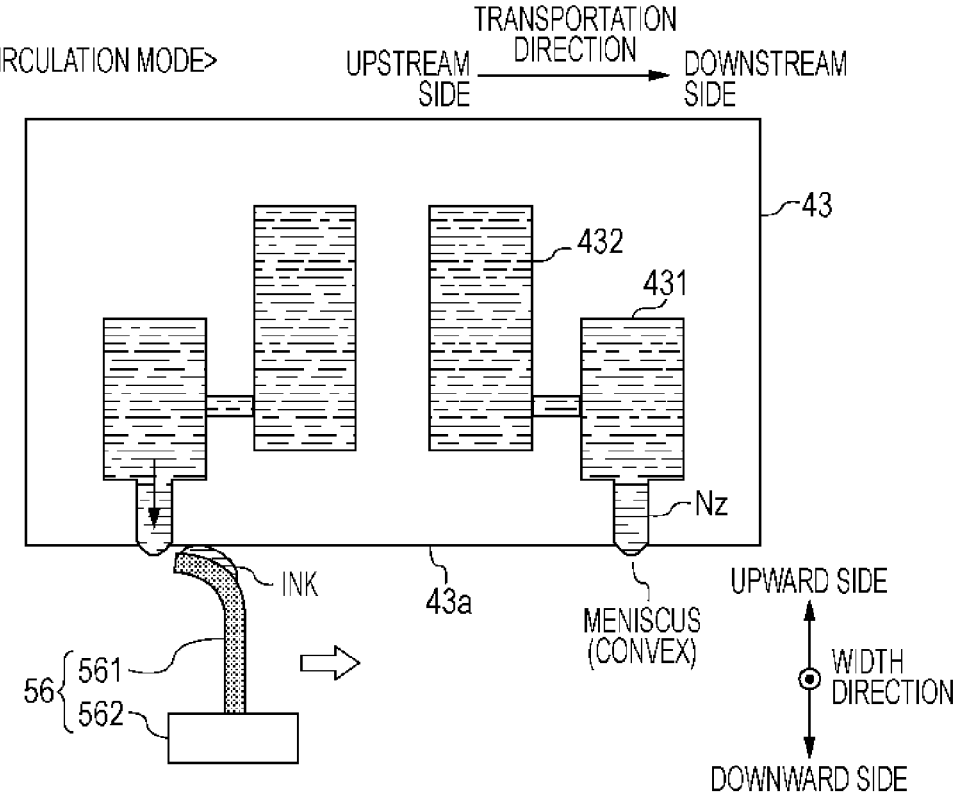

FIGS. 4A and 4B are views describing a wiping operation of Comparison Example. Similarly to when an image is printed, in FIG. 4A, the circulation pump P rotates at the low speed (the number of revolutions is N0), the transfer rate (q0) of ink per unit time by the circulation pump P is low, and in a state where a pressure increase in the ink tank 54 by the pressure regulation apparatus 53 is suspended (in a state where a pressure in the ink tank 54 is P0), the wiping operation is carried out. That is, in FIG. 4A, in the "low speed circulation" mode in which the flow rate (Q0) of ink flowing through the circulation flow path per unit time is low, the wiping operation is carried out. In this case, since a pressure applied to ink in the head 43 is low, a meniscus (free surface of ink exposed from the nozzle Nz) of the ink formed at the nozzle Nz is drawn to the inside of the head 43 (to a side of the ink chamber 431) farther inward than the nozzle opening surface 43*a* of the head 43, to have a concave shape.

When the wiping operation is carried out, ink in the nozzle Nz is guided by ink adhering to the wiper 561, and is drawn out by the wiper 561. For this reason, as illustrated in FIG. 4A, when a pressure applied to the ink in the head 43 is low, even though the ink in the nozzle Nz is drawn out by the wiper 561, the nozzle Nz is not replenished with ink, and air bubbles remain in the nozzle Nz. In this case, a discharge failure occurs such that ink is not discharged from the nozzle Nz during printing, and image quality of a printed image deteriorates.

In contrast, in FIG. 4B, a pressure increase in the ink tank 54 by the pressure regulation apparatus 53 is suspended, and compared to when an image is printed, the number of revolutions (N1) of the circulation pump P is set to be high (N0<N1), and in a "high speed circulation" mode in which the flow rate (Q1) of ink flowing through the circulation flow path per unit time increases (Q0<Q1), the wiping operation is carried out. In this case, since a pressure applied to the ink in the head 43 is great compared to when an image is printed, a meniscus of the ink formed at the nozzle Nz protrudes to the outside of the head 43 farther outward than the nozzle opening surface 43*a* of the head 43, to have a convex shape. For this reason, when the wiping operation is carried out, even though the ink in the nozzle Nz is drawn out by the wiper 561, the nozzle Nz is replenished with ink and can be refilled with the ink.

However, as illustrated in FIG. 4A, when an image is printed, an appropriate shape of a meniscus is a concave shape in which the meniscus is drawn to the inside of the head 43. For this reason, as illustrated in FIG. 4B, when the wiping operation is finished in a state where the meniscus protrudes to the outside of the head 43 to have a convex shape, once ink is discharged from the nozzle Nz one time by use of the piezoelectric element at the time of printing an image, the ink continues to leak from the nozzle Nz and thus, a printing cannot be appropriately carried out.

In the embodiment, by the wiping operation, foreign matter such as ink is removed from the nozzle opening surface 43*a* of the head 43 such that the nozzle opening surface 43*a* is cleaned, and the nozzle Nz is prevented from failing to discharge ink.

EXAMPLE 1

Figure 5:
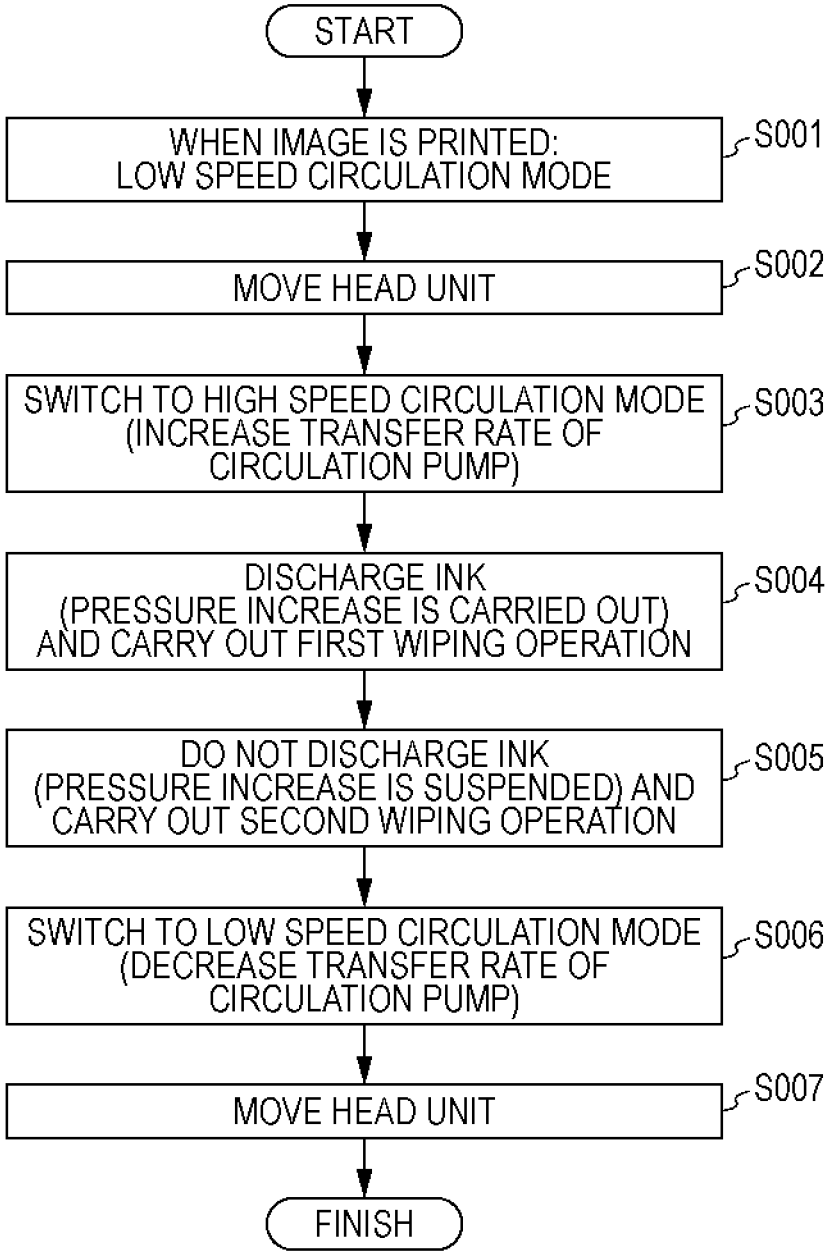
FIG. 5 is a flow chart of a head cleaning method in Example 1.

FIG. 5 is a flow chart illustrating a method of cleaning the head 43 in Example 1, and FIGS. 6A to 6D illustrate the method of cleaning the head 43 in Example 1. As described above, when an image is printed, the circulation pump P rotates at the low speed (the number of revolutions is N0), the transfer rate (q0) of ink per unit time by the circulation pump P is low, and a pressure increase in the ink tank 54 by the pressure regulation apparatus 53 is suspended (in a state where a pressure in the ink tank 54 is P0). For this reason, when the image is printed, the printer 1 is set to the "low speed circulation" mode in which the flow rate (Q0) of the ink flowing through the circulation flow path per unit time is low (S001).

Figure 6A:
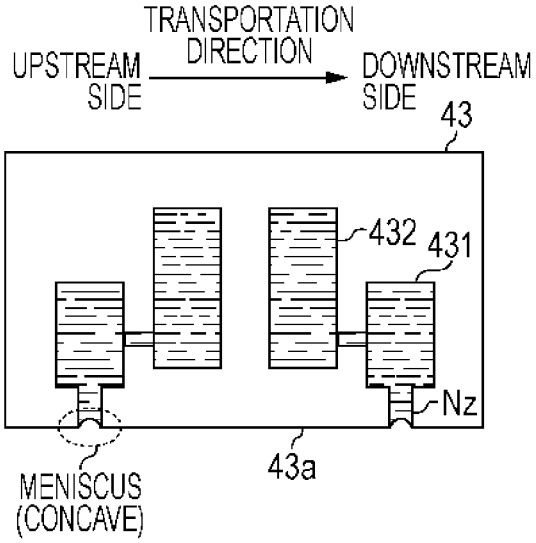
FIGS. 6A to 6D illustrate the head cleaning method in Example 1.

When a predetermined time elapses from a previous operation of cleaning the head 43, the controller 10 temporarily stops printing the image or finishes the printing job in execution, then controller 10 moves the head unit 41 to the distal side in the width direction up to a region in which the wiper 561 is positioned (S002). The controller 10 moves the head unit 41 downward with respect to the wiper 561 in such a manner that a tip end of the wiper 561 comes into contact with the nozzle opening surface 43*a* of the head 43. At this time, as illustrated in FIG. 6A, the meniscus formed at the nozzle Nz is drawn to the inside of the head 43 farther inward than the nozzle opening surface 43*a* of the head 43, to have a concave shape.

The invention is not limited to a case where the cleaning operation is executed at every predetermined time, and for example, the cleaning operation may be executed whenever an image is printed on the continuous-form paper S with a predetermined length, or the cleaning operation may be executed by a command of a user. The invention is not limited to a case where the head unit 41 moves downward, and the wiper 561 may move upward with respect to the head unit 41, or both of the head unit 41 and the wiper 561 may move. The cleaning operation may be simultaneously executed for the four head units 41, the cleaning operation may be sequentially executed for each of the head units 41, or the cleaning operation may be executed for only the head unit 41 in use.

Figure 6B:
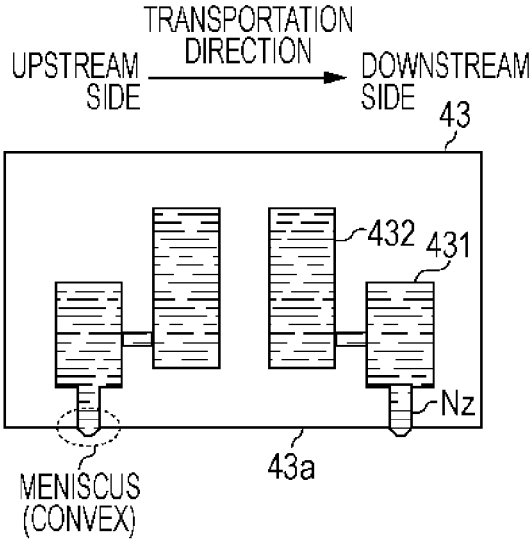

Subsequently, in a state where a pressure increase in the ink tank 54 by the pressure regulation apparatus 53 is suspended, the controller 10 changes the number of revolutions of the circulation pump P from the low speed (N0) to the high speed (N1) (N0<N1), and the controller 10 increases a transfer rate (q1) of the ink per unit time by the circulation pump P to a transfer rate greater than the transfer rate (q0) when the image is printed (q0<q1). In this way, the controller 10 switches the flow rate (Q1, equivalent to the first flow rate) of the ink flowing through the circulation flow path per unit time to the "high speed circulation" mode of which the flow rate is greater than the flow rate (Q0) in the "low speed circulation" mode (S003, equivalent to the first process). For example, when the high speed circulation mode is enabled, the flow rate (Q1) of the ink flowing through the circulation flow path per unit time becomes two times the flow rate (Q0) in the low speed circulation mode. As a result, as illustrated in FIG. 6B, a pressure applied to ink in the head 43 increases, the ink is not discharged from the nozzle Nz, and a meniscus formed at the nozzle Nz protrudes to the outside of the head 43 farther outward than the nozzle opening surface 43*a* of the head 43, to have a convex shape.

Figure 6C:
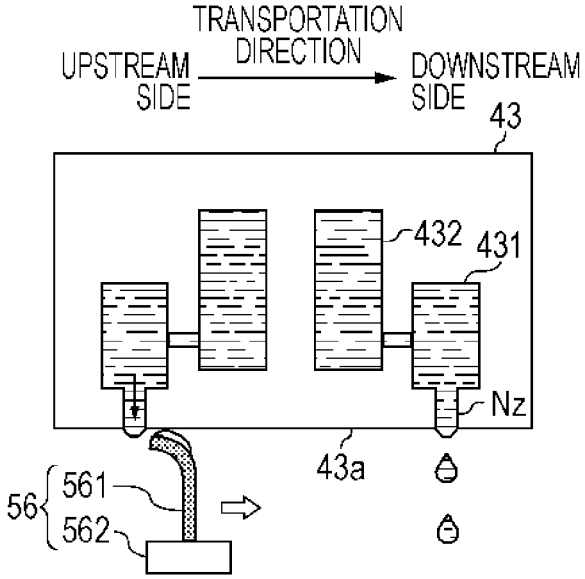

Subsequently, in a state where the number of revolutions of the circulation pump P is set at the high speed (N1), the controller 10 controls the pressure regulation apparatus 53 in such a manner that a pressure in the ink tank 54 increases to be greater (P0+α) than the pressure (P0) when the image is printed, by applying a pressure of the ink tank 54. Accordingly, a flow rate (Q2) of the ink flowing through the circulation flow path per unit time increases to be much greater than the flow rate (Q1) at stage S003 (Q1<Q2). As a result, as illustrated in FIG. 6C, a pressure applied to the ink in the head 43 further increases (for example, to 29 kPa), and the ink is discharged from the nozzle Nz. The ink discharging method is different from the method in which, when an image is printed, the piezoelectric element is driven and thus the ink is discharged from the nozzle Nz.

In a state where the ink is discharged from the nozzle Nz, the controller 10 moves the wiper 561 with respect to the head 43 (head unit 41) from the upstream of the transportation direction to the downstream thereof while the tip end of the wiper 561 is in contact with the nozzle opening surface 43*a* of the head 43, and a first wiping operation is carried out (S004, equivalent to the second process). As a result, the wiper 561 can wipe off foreign matter such as ink adhering to the nozzle opening surface 43*a* of the head 43. Even when the wiping operation is carried out while the ink is discharged from the nozzle Nz, the ink in the nozzle Nz is drawn out by the wiper 561, but since a pressure applied to the ink in the head 43 is great, the nozzle Nz is replenished with the ink.

In a case where ink adheres to the nozzle opening surface 43*a* of the head 43 for a long time, the ink thickens and solidifies, and the thickened and solidified ink is hard to peel off from the nozzle opening surface 43*a*. For this reason, when the wiping operation is carried out while the ink is discharged from the nozzle Nz, it is possible to carry out the wiping operation while the thickened and solidified ink is dissolved by the wiper 561 wet with the ink discharged from the nozzle Nz. Accordingly, compared to when only the wiping operation is carried out without the ink being discharged from the nozzle Nz, it is possible to more thoroughly clean the nozzle opening surface 43*a* of the head 43. In other words, since it is not necessary to increase a force at which the wiper 561 is in contact with the nozzle opening surface 43*a* of the head 43 so as to wipe off the thickened and solidified ink, it is possible to suppress scratching of the nozzle opening surface 43*a* of the head 43.

Figure 6D:
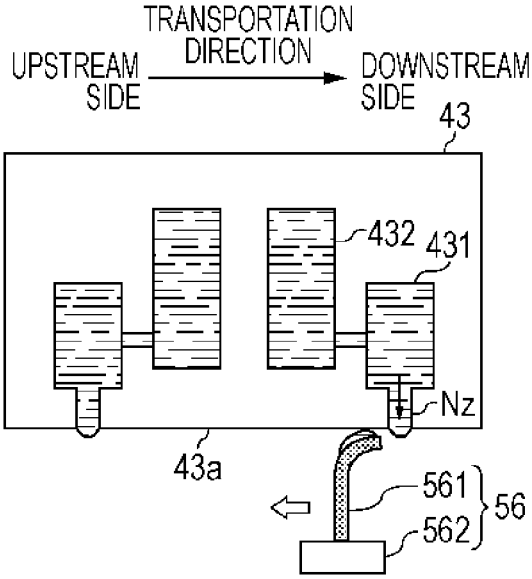

Subsequently, in a state where the number of revolutions of the circulation pump P is set at the high speed (N1), the controller 10 suspends a pressure increase in the ink tank 54 by the pressure regulation apparatus 53 to return a pressure in the ink tank 54 to the pressure (P0). As a result, a flow rate of the ink flowing through the circulation flow path per unit time becomes equal to the flow rate at stage 5003 (Q1). As a result, a pressure applied to the ink in the head 43 becomes low compared to the pressure at stage S004 (for example, to 11 kPa), and as illustrated in FIG. 6D, the nozzle Nz stops discharging the ink, and a meniscus formed at the nozzle Nz protrudes to the outside of the head 43 farther outward than the nozzle opening surface 43*a* of the head 43, to have a convex shape. In this state, the controller 10 moves the wiper 561 with respect to the head 43 from the downstream of the transportation direction to the upstream thereof while the tip end of the wiper 561 is in contact with the nozzle opening surface 43*a* of the head 43. That is, when the controller 10 moves the wiper 561 in a direction opposite the direction in which the first wiping operation is carried out, a second wiping operation is carried out (S005, equivalent to the third process). As a result, it is possible to wipe off residue left over after the first wiping operation is completed, and since the first wiping operation is carried out while the ink is discharged from the nozzle Nz, it is possible to wipe off the ink adhering to the nozzle opening surface 43*a*. Accordingly, it is possible to more thoroughly clean the nozzle opening surface 43*a* of the head 43. The invention is not limited to a case where a flow rate of the ink flowing through the circulation flow path per unit time is equal to the flow rate at stage S003, and the flow rate of the ink flowing through the circulation flow path per unit time is preferably set at a flow rate at which the ink is not discharged from the nozzle Nz and the meniscus has a convex shape.

As such, in a state where the ink is not discharged from the nozzle Nz, but the flow rate (Q1) of the ink flowing through the circulation flow path per unit time is set at a flow rate greater than the flow rate (Q0) when the image is printed, and in a state where a pressure applied to the ink in the head 43 increases to a level at which a meniscus formed at the nozzle Nz has a convex shape, when the wiping operation is carried out, even though the wiper 561 removes the ink in the nozzle Nz, it is possible to replenish the nozzle Nz with ink, and to prevent air bubbles from remaining in the nozzle Nz. That is, it is possible to finish the wiping operation in a state where the nozzle is refilled with the ink.

When a return operation of the wiper 561 is not provided between the first and the second wiping operations and movement directions of the wiper 561 in the first and the second wiping operations are opposite to each other, it is possible to reduce a time for a cleaning operation. Immediately after a pressure increase in the ink tank 54 by the pressure regulation apparatus 53 is suspended, a flow rate of the ink flowing through the circulation flow path per unit time is greater due to a residual pressure compared to when a pressure is stabilized. For this reason, immediately after a pressure increase in the ink tank 54 by the pressure regulation apparatus 53 is suspended in a state where the return operation of the wiper 561 is not provided, when the second wiping operation is carried out, it is possible to carry out the wiping operation in a state where a pressure applied to the ink in the head 43 is greater due to a residual pressure compared to when a pressure is stabilized. Accordingly, even though the wiper 561 removes the ink in the nozzle Nz, it is possible to more reliably replenish the nozzle Nz with ink. The invention is not limited to the operational configuration, but the wiper 561 may move in the same direction in both of the first and the second wiping operations.

Subsequently, in a state where a pressure increase in the ink tank 54 by the pressure regulation apparatus 53 is suspended, the controller 10 changes the number of revolutions of the circulation pump P from the high speed (N1) to the low speed (N0), and the controller 10 sets the transfer rate (q0) of the ink per unit time by the circulation pump P at the same as that when the image is printed. In this way, the controller 10 switches the flow rate (Q0, equivalent to the second flow rate) of the ink flowing through the circulation flow path per unit time to the "low speed circulation" mode in which the flow rate is lower than the flow rate (Q1) in the high speed circulation mode (S006, equivalent to the fourth process). As a result, as illustrated in FIG. 6A, a pressure applied to ink in the head 43 becomes low (for example, 9.5 kPa), and a meniscus formed at the nozzle Nz is drawn to the inside of the head 43 farther inward than the nozzle opening surface 43*a* of the head 43, to have a concave shape. That is, it is possible to finish the cleaning operation in a state where the meniscus is appropriately set when an image is printed.

Finally, the controller 10 moves the head unit 41 upward with respect to the wiper 561, and moves the head unit 41 to a proximal side in the width direction in such a manner that the head unit 41 faces the continuous-form paper S on the platen 42 (S007). In this way, a cleaning operation of the head 43 is finished, and the controller 10 restarts printing an image. At this time, as illustrated in FIG. 6A, since the meniscus formed at the nozzle Nz has a concave shape, when a discharge of the ink is controlled by use of the piezoelectric element, it is possible to appropriately control a discharge or a non-discharge of the ink.

As described above, in Example 1, since a transfer rate (feed rate) of the ink by the circulation pump P increases (q0→q1), a flow rate of the ink flowing through the circulation flow path per unit time increases compared to when an image is printed (Q0→Q1) and thereafter, in a state where the transfer rate of the ink by the circulation pump P remains unchanged and the pressure regulation apparatus 53 increases a pressure in the ink tank 54, the first wiping operation is carried out and thereafter, in a state where the transfer rate of the ink by the circulation pump P remains unchanged and the pressure regulation apparatus 53 stops increasing a pressure in the ink tank 54, the second wiping operation is carried out and thereafter, the transfer rate of the ink by the circulation pump P decreases (q1→q0).

In this way, it is possible to carry out the first wiping operation in a state where the ink is discharged from the nozzle Nz and thereafter, it is possible to carry out the second wiping operation in a state where the ink is not discharged from the nozzle Nz and thereafter, it is possible to decrease the flow rate of the ink flowing through the circulation flow path per unit time. Accordingly, it is possible to carry out the wiping operation while dissolving a thickened and solidified ink that adheres to the nozzle opening surface 43*a* of the head 43. In addition, it is possible to finish the cleaning operation in a state where the nozzle Nz is replenished with ink and the meniscus formed at the nozzle Nz is set to have an appropriate shape when an image is printed.

In particular, when the second wiping operation is carried out, since the meniscus formed at the nozzle Nz protrudes to the outside of the head 43 farther outward than the nozzle opening surface 43*a* of the head 43, it is possible to more reliably to replenish the nozzle Nz with ink. After the second wiping operation is completed, in a state where the meniscus formed at the nozzle Nz is drawn to the inside of the head 43 farther inward than the nozzle opening surface 43*a* of the head 43 and thus, the nozzle Nz can appropriately discharge the ink, it is possible to finish the cleaning operation.

After the second wiping operation is completed, the flow rate of ink flowing through the circulation flow path per unit time is set equal to the flow rate (Q0) of the ink flowing through the circulation flow path per unit when an image is printed. In this way, immediately after the cleaning operation is finished, it is possible to start printing an image. That is, after the second wiping operation is completed, an operation at stage S006 is equivalent to a printing preparation operation. The invention is not limited to the configuration, but the flow rate of the ink flowing through the circulation flow path per unit time after the second wiping operation is completed may be set to be different from the flow rate of the ink when an image is printed.

When not only foreign matter such as ink adheres to the nozzle opening surface 43*a* of the head 43, but also the ink thickens in the nozzle Nz which is less frequently used and the thickened ink clogs up the less frequently-used nozzle Nz, or air bubbles or thickened ink is mixed with the ink in the nozzle Nz or the head 43, the nozzle Nz fails to discharge the ink. In the operation of cleaning the head 43 according to the embodiment, at stage S004 of FIG. 5, when the number of revolutions of the circulation pump P is set at the high speed (N1), and the pressure regulation apparatus 53 increases a pressure in the ink tank 54, since the nozzle Nz discharges air bubbles or thickened ink together with normal ink, it is possible to resolve a discharge failure of the nozzle Nz caused by the air bubbles or the thickened ink. In a state where the cap 51 is in close contact with the nozzle opening surface 43*a* of the head 43, when the number of revolutions of the circulation pump P is set at the high speed (N1), air bubbles or thickened ink in the head 43, the forward-path tube 55*a* or the return-path tube 55*b* can flow to the ink tank 54, and it is possible to resolve a discharge failure of the nozzle Nz caused by the air bubbles or the thickened ink and thus, such an operation may be added to the flow chart in FIG. 5.

EXAMPLE 2

Figure 7:
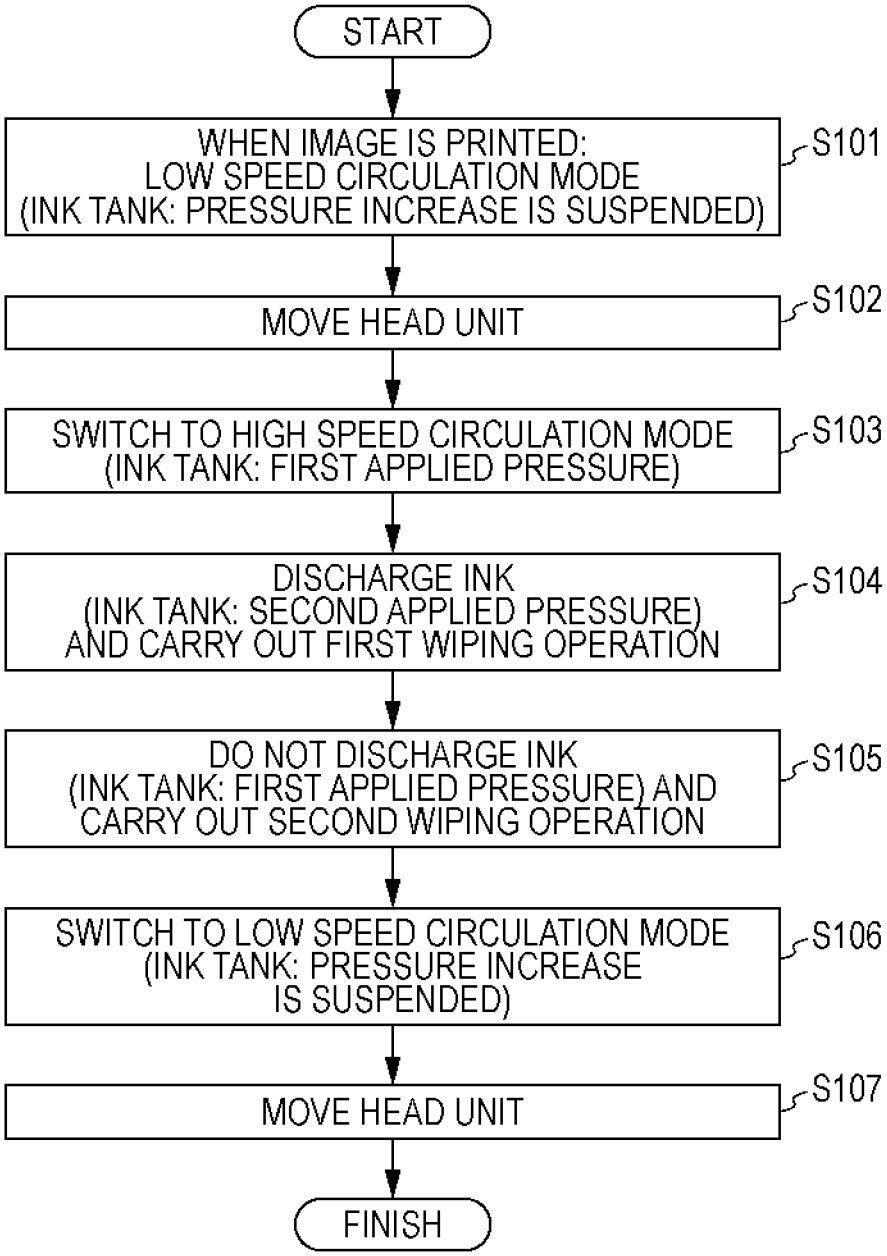
FIG. 7 is a flow chart of a head cleaning method in Example 2.

FIG. 7 is a flow chart illustrating a method of cleaning the head 43 in Example 2. In Example 2, when the number of revolutions of the circulation pump P is set to be constant, that is, the transfer rate of the ink per unit time by the circulation pump P is set to be constant, and the pressure regulation apparatus 53 regulates a pressure in the ink tank 54, a discharge state or a meniscus state of the ink from the nozzle Nz is controlled. Conditions when an image is printed are the same as those in Example 1. That is, the circulation pump P rotates at the low speed (N0), the transfer rate (q0) of ink per unit time by the circulation pump P is low, a pressure increase in the ink tank 54 by the pressure regulation apparatus 53 is suspended (in a state where a pressure in the ink tank 54 is P0), and the printer 1 is set to the "low speed circulation" mode in which the flow rate (Q0) of the ink flowing through the circulation flow path per unit time is low (S101). First, in order to clean the head 43, the controller 10 moves the head unit 41 in such a manner that the wiper 561 comes into contact with the nozzle opening surface 43*a* of the head 43 (S102). At this time, the meniscus formed at the nozzle Nz has a convex shape (FIG. 6A).

Subsequently, the controller 10 controls the pressure regulation apparatus 53 in such a manner that a pressure in the ink tank 54 is set at a "first applied pressure (P1, equivalent to the first pressure)" that is greater than the pressure (P0) when an image is printed (P1 >P0). In this way, the printer 1 is set to the "high speed circulation" mode in which the flow rate (Q1) of the ink flowing through the circulation flow path per unit time is greater than the flow rate (Q0) in the low speed circulation mode (S103, equivalent to the first process). As a result, the ink is not discharged from the nozzle Nz, but the meniscus formed at the nozzle Nz has a convex shape (FIG. 6B).

Subsequently, the controller 10 controls the pressure regulation apparatus 53 in such a manner that a pressure in the ink tank 54 is set at a "second applied pressure (P2, equivalent to the second pressure)" that is much greater than that at stage S103 (P2>P1). In this way, the flow rate (Q2) of the ink flowing through the circulation flow path per unit time increases to be greater than the flow rate (Q1) at stage S103 (Q1<Q2). As a result, in a state where the ink is discharged from the nozzle Nz, it is possible to carry out a first wiping operation (S104, equivalent to the second process). In this way, it is possible to carry out the wiping operation while dissolving thickened and solidified ink.

Subsequently, the controller 10 controls the pressure regulation apparatus 53 in such a manner that a pressure in the ink tank 54 returns to the "first applied pressure (P1, equivalent to the third pressure)" that is lower than that at stage S104 and is the same as that at stage S103. In this way, the flow rate (Q1) of the ink flowing through the circulation flow path per unit time becomes the same as that at stage S103. As a result, in a state where the ink is not discharged from the nozzle Nz and the meniscus formed at the nozzle Nz has a convex shape (FIG. 6B), it is possible to carry out a second wiping operation (S105, equivalent to the third process). In this way, it is possible to more thoroughly clean the nozzle opening surface 43*a* of the head 43. In addition, even though the wiper 561 removes the ink in the nozzle Nz, it is possible to replenish the nozzle Nz with ink, and in a state where the nozzle Nz is refilled with the ink, it is possible to finish the wiping operation. The invention is not limited to a case where a pressure in the ink tank 54 is set at the same as that at stage S103, and the pressure in the ink tank 54 may be set at a pressure at which the ink is not discharged from the nozzle Nz and the meniscus has a convex shape.

Subsequently, the controller 10 suspends a pressure increase in the ink tank 54 by the pressure regulation apparatus 53, and the controller 10 returns a pressure in the ink tank 54 to the pressure (P0, equivalent to the fourth pressure) when an image is printed which is lower than the first applied pressure (P1) at stages S103 and S105, and returns the flow rate (Q0) of the ink flowing through the circulation flow path per unit time to the flow rate in the low speed circulation mode which is lower than the flow rate (Q1) in the high speed circulation mode (S106, equivalent to the fourth process). Finally, the controller 10 moves the head unit 41 (S107), and restarts printing an image. At this time, since the meniscus formed at the nozzle Nz has a concave shape (FIG. 6A), it is possible to appropriately control a discharge of the ink by use of the piezoelectric element.

EXAMPLE 3

Figure 8:
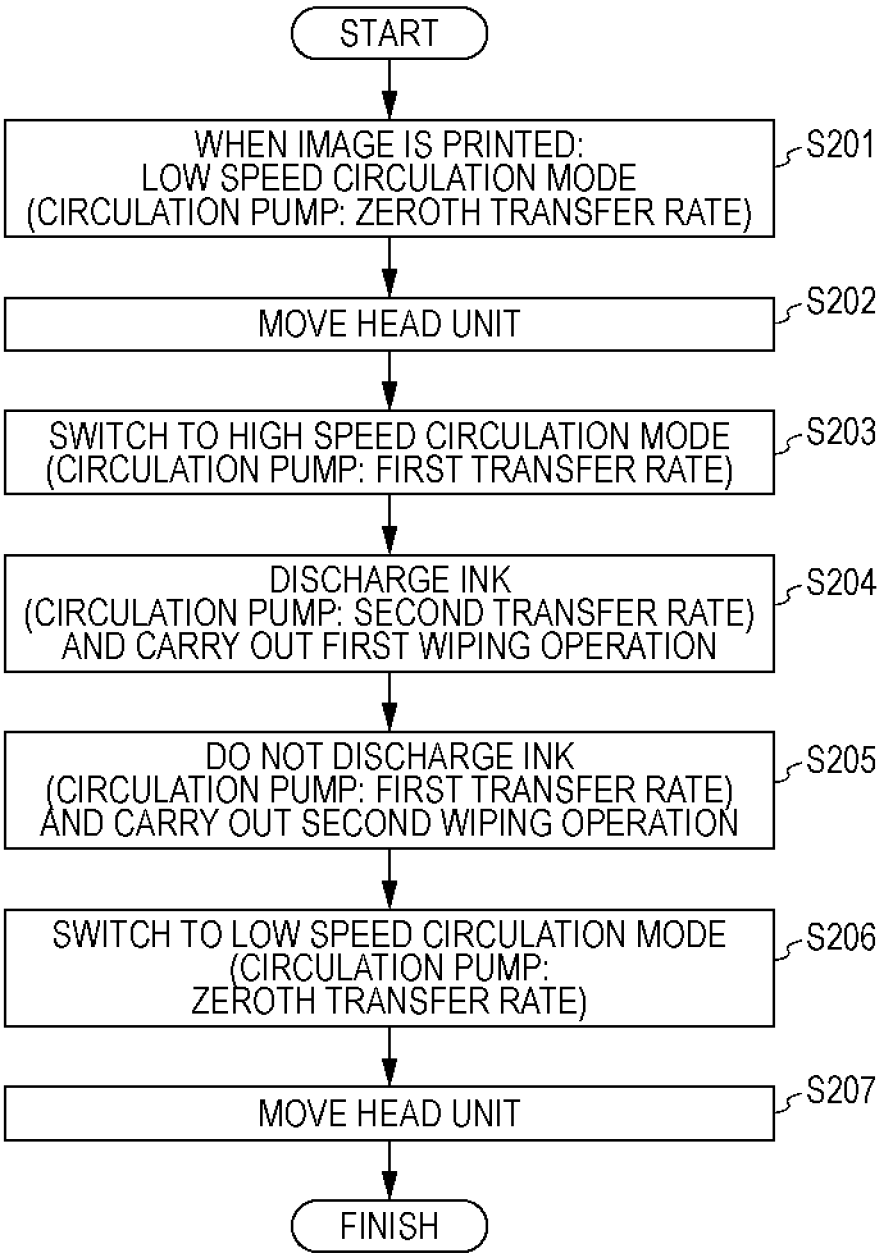
FIG. 8 is a flow chart of a head cleaning method in Example 3.

FIG. 8 is a flow chart illustrating a method of cleaning the head 43 in Example 3. In Example 3, in a state where a pressure increase in the ink tank 54 by the pressure regulation apparatus 53 is suspended, when the number of revolutions of the circulation pump P is regulated, that is, a transfer rate of ink per unit time by the circulation pump P is regulated, a discharge state or a meniscus state of the ink from the nozzle Nz is controlled. Conditions when an image is printed are the same as those in Example 1 (S201), the circulation pump P rotates at the low speed (N0), and a transfer rate of the ink per unit time by the circulation pump P is a "zeroth transfer rate (q0)". In order to clean the head 43, the controller 10 moves the head unit 41 (S202). At this time, the meniscus formed at the nozzle Nz has a concave shape (FIG. 6A).

Subsequently, the controller 10 sets the number of revolutions of the circulation pump P at the high speed (N1), and sets the transfer rate of the ink per unit time by the circulation pump P at a "first transfer rate (q1, equivalent to the first feed rate)" that is greater than the zeroth transfer rate (q0) when an image is printed (q1>q0). In this way, the printer 1 is set to the "high speed circulation" mode in which the flow rate (Q1) of the ink flowing through the circulation flow path per unit time is greater than the flow rate (Q0) in the low speed circulation mode (S203, equivalent to the first process). As a result, the ink is not discharged and the meniscus formed at the nozzle Nz has a convex shape (FIG. 6B).

Subsequently, the controller 10 sets the number of revolutions of the circulation pump P at a speed that is much greater than the high speed, and sets the transfer rate of the ink per unit time by the circulation pump P at a "second transfer rate (q2, equivalent to the second feed rate)" that is greater than that at stage S203 (q2>q1). In this way, the flow rate (Q2) of the ink flowing through the circulation flow path per unit time increases to be greater than the flow rate (Q1) at stage S203 (Q1<Q2). As a result, in a state where the ink is discharged from the nozzle Nz, it is possible to carry out a first wiping operation (S204, equivalent to the second process). In this way, it is possible to carry out the wiping operation while dissolving thickened and solidified ink.

Subsequently, the controller 10 decreases the number of revolutions of the circulation pump P, and returns the transfer rate of the ink per unit time by the circulation pump P to the "first transfer rate (q1, equivalent to the third feed rate)" that is lower than that at stage S204 and is the same as that at stage S203. In this way, the flow rate (Q1) of the ink flowing through the circulation flow path per unit time becomes the same as that at stage S203. As a result, in a state where the ink is not discharged from the nozzle Nz and the meniscus formed at the nozzle Nz has a convex shape (FIG. 6B), it is possible to carry out a second wiping operation (S205, equivalent to the third process). In this way, it is possible to more thoroughly clean the nozzle opening surface 43*a* of the head 43. In addition, even though the wiper 561 removes the ink in the nozzle Nz, it is possible to replenish the nozzle Nz with ink, and in a state where the nozzle Nz is refilled with the ink, it is possible to finish the wiping operation. The invention is not limited to a case where the transfer rate of the circulation pump P is set at the same as that at stage S203, and the transfer rate may be set at a transfer rate at which the ink is not discharged from the nozzle Nz and the meniscus has a convex shape.

Subsequently, the controller 10 returns the number of revolutions of the circulation pump P to the low speed (N0), the controller 10 sets a transfer rate (equivalent to the fourth feed rate) of the ink per unit time by the circulation pump P at the zeroth transfer rate (q0) when an image is printed which is lower than the first transfer rate (q1) at stages S203 and S205, and the controller 10 returns the flow rate (Q0) of the ink flowing through the circulation flow path per unit time to that in the low speed circulation mode which is lower than the flow rate (Q1) in the high speed circulation mode (S206, equivalent to the fourth process). Finally, the controller 10 moves the head unit 41 (S207), and restarts printing an image. At this time, as illustrated in FIG. 6A, since the meniscus formed at the nozzle Nz has a concave shape, it is possible to appropriately control a discharge of the ink by use of the piezoelectric element.

Other Embodiments

The embodiment is described to facilitate an understanding of the invention, and the invention is not limited to the embodiment. Modifications and improvements can be made to the invention without departing from the spirit of the invention, and the invention includes equivalents thereof.

The embodiment is an example in which the head unit 41 discharges ink onto a recording medium transported without stopping below the head unit 41 to which the nozzles Nz are fixed in rows over a length equal to or greater than that in the width direction of the recording medium and thus, the printer 1 prints a 2-dimensional image, but the invention is not limited to the embodiment. For example, a printer may repeat an operation in which one or a plurality of heads discharge ink onto a recording medium positioned in a printing region while moving in both X and Y directions and thus, a 2-dimensional image is printed, and an operation in which the recording medium is transported in the X direction and thus, a new portion of the recording medium is supplied to the printing region. For example, a printer may repeat an operation in which one or a plurality of heads discharge ink while moving in a direction (in a width direction of a recording medium) orthogonal to a direction of nozzle columns, and a transportation operation in which the medium is transported in the direction of nozzle columns (in a direction where the medium is continuous when the recording medium is a continuous medium). For example, a printer may repeat an operation in which ink is discharged onto a recording medium that is moved in an X direction with respect to one or a plurality of heads, and an operation in which the recording medium is moved in a Y direction with respect to the heads.

In the embodiment, an ink jet printer is taken as an example of the liquid discharging apparatus, but the invention is not limited to the ink jet printer. For example, the liquid discharging apparatus may be a color filter manufacturing apparatus, a display manufacturing apparatus, a semiconductor manufacturing apparatus, a DNA chip manufacturing apparatus and the like.

The entire disclosure of Japanese Patent Application No. 2013-065770, filed Mar. 27, 2013 is expressly incorporated by reference herein.

What is claimed is:

1. A head cleaning method in a liquid discharging apparatus that includes a circulation flow path having a head at which a nozzle is provided to discharge liquid onto a recording medium, a storage unit that stores the liquid, a first flow path through which the liquid is supplied from the storage unit to the head, and a second flow path through which the liquid flows back to the storage unit from the head; a pump that circulates the liquid through the circulation flow path; and a wiping unit that moves relative to the head in a state where the wiping unit is in contact with a nozzle opening surface of the head and thus, carries out a wiping operation in which foreign matter adhering to the nozzle opening surface is wiped off, the head cleaning method comprising:

a first process of setting a flow rate of the liquid flowing through the circulation flow path per unit time at a first flow rate;

a second process of carrying out the wiping operation by the wiping unit in a state where the liquid is discharged from the nozzle after the first process is completed;

a third process of carrying out the wiping operation by the wiping unit in a state where the liquid is not discharged from the nozzle after the second process is completed, wherein the wiping process performed in the second process and the third process is performed while the liquid flowing through the circulation path at the first flow rate provides pressure to the head; and a fourth process of setting a flow rate of the liquid flowing through the circulation flow path per unit time at a second flow rate that is lower than the first flow rate after the third process is completed.

2. The head cleaning method according to claim 1, wherein in the third process, a meniscus of the liquid formed at the nozzle protrudes to an outside of the head farther outward than the nozzle opening surface, and wherein in the fourth process, the meniscus is drawn to an inside of the head farther inward than the nozzle opening surface.

3. The head cleaning method according to claim 1, wherein when the liquid is discharged onto the recording medium, a flow rate of the liquid flowing through the circulation flow path per unit time is set equal to the second flow rate.

4. The head cleaning method according to claim 1, wherein the liquid discharging apparatus includes a pressure regulation unit that regulates a pressure in the storage unit, wherein a rate of the liquid fed by the pump is constant from the first process to the fourth process, wherein in the first process, the pressure regulation unit sets a pressure in the storage unit at a first pressure and thus, a flow rate of the liquid flowing through the circulation flow path per unit time is set at the first flow rate, wherein in the second process, the pressure regulation unit sets a pressure in the storage unit at a second pressure that is greater than the first pressure, wherein in the third process, the pressure regulation unit sets a pressure in the storage unit at a third pressure that is lower than the second pressure, and wherein in the fourth process, the pressure regulation unit sets a pressure in the storage unit at a fourth pressure that is lower than the first and the third pressures.

5. The head cleaning method according to claim 1, wherein in the first process, a rate of the liquid fed by the pump is set at a first feed rate and thus, a flow rate of the liquid flowing through the circulation flow path per unit time is set at the first flow rate, wherein in the second process, a rate of the liquid fed by the pump is set at a second feed rate that is greater than the first feed rate, wherein in the third process, a rate of the liquid fed by the pump is set at a third feed rate that is lower than the second feed rate, and wherein in the fourth process, a rate of the liquid fed by the pump is set at a fourth feed rate that is lower than the first and the third feed rates.

6. A head cleaning method in a liquid discharging apparatus that includes a circulation flow path having a head at which a nozzle is provided to discharge liquid onto a recording medium, a storage unit that stores the liquid, a first flow path through which the liquid is supplied from the storage unit to the head, and a second flow path through which the liquid flows back to the storage unit from the head; a pump that circulates the liquid through the circulation flow path; and a wiping unit that moves relative to the head in a state where the wiping unit is in contact with a nozzle opening surface of the head and thus, carries out a wiping operation in which foreign matter adhering to the nozzle opening surface is wiped off, the head cleaning method comprising:

a first process of setting a flow rate of the liquid flowing through the circulation flow path per unit time at a first flow rate;

a second process of carrying out the wiping operation by the wiping unit in a state where the liquid is discharged from the nozzle after the first process is completed;

a third process of carrying out the wiping operation by the wiping unit in a state where the liquid is not discharged from the nozzle after the second process is completed; and a fourth process of setting a flow rate of the liquid flowing through the circulation flow path per unit time at a second flow rate that is lower than the first flow rate after the third process is completed, wherein the liquid discharging apparatus includes a pressure regulation unit that regulates a pressure in the storage unit, wherein in the first process, a rate of the liquid fed by the pump is regulated and thus, a flow rate of the liquid flowing through the circulation flow path per unit time is set at the first flow rate, wherein in the second process, the pressure regulation unit increases a pressure in the storage unit in a state where a rate of the liquid fed by the pump remains unchanged from that of the first process, wherein in the third process, the pressure regulation unit stops increasing a pressure in the storage unit in a state where a rate of the liquid fed by the pump remains unchanged from that of the first process, and wherein in the fourth process, a rate of the liquid fed by the pump decreases compared to in the first process.

7. A liquid discharging apparatus comprising:

a circulation flow path that includes a head at which a nozzle is provided to discharge liquid onto a recording medium, a storage unit that stores the liquid, a first flow path through which the liquid is supplied from the storage unit to the head, and a second flow path through which the liquid flows back to the storage unit from the head;

a pump that circulates the liquid through the circulation flow path; and a wiping unit that moves relative to the head in a state where the wiping unit is in contact with a nozzle opening surface of the head and thus, carries out a wiping operation in which foreign matter adhering to the nozzle opening surface is wiped off;

a control unit that sets a flow rate of the liquid flowing through the circulation flow path per unit time at a first flow rate and then, commands the wiping unit to carry out the wiping operation in a state where the liquid is discharged from the nozzle and then, commands the wiping unit to carry out the wiping operation in a state where the liquid is not discharged from the nozzle and then, sets a flow rate of the liquid flowing through the circulation flow path per unit time at a second flow rate that is lower than the first flow rate, wherein the wiping operation is performed while the liquid flowing through the circulation path at the first flow rate provides pressure to the head.

* * * * *